United States Patent [19]

Konkle

[11] Patent Number: 4,844,398

[45] Date of Patent: Jul. 4, 1989

[54] DROP LEAF SUPPORT WITH SAFETY RING AND COVER

[75] Inventor: Douglas R. Konkle, Wabash, Ind.

[73] Assignee: B. Walter & Co., Inc., Wabash, Ind.

[21] Appl. No.: 205,388

[22] Filed: Jun. 10, 1988

[51] Int. Cl.[4] ..... A47G 29/02

[52] U.S. Cl. ..... 248/240.4; 16/223; 108/80; 108/82

[58] Field of Search ..... 248/240.4, 235, 240.3, 248/240; 108/80, 81, 82, 160; 16/233, 223, 281

[56] References Cited

U.S. PATENT DOCUMENTS

| | | | |
|---|---|---|---|
| 1,552,988 | 9/1925 | Hoberg et al. . | |
| 1,842,954 | 1/1932 | Anderson | 248/240.4 |
| 1,874,424 | 8/1932 | Benson . | |
| 1,918,040 | 2/1929 | Kassick . | |
| 2,031,759 | 2/1936 | Casper | 108/81 |
| 2,154,125 | 4/1939 | Dillon | 108/81 X |
| 2,272,854 | 2/1942 | Sloane et al. | 16/223 X |
| 2,284,003 | 5/1942 | Luppert | 108/82 X |
| 2,314,144 | 3/1943 | Hicks . | |
| 2,316,447 | 4/1943 | McFall | 108/82 X |
| 2,329,293 | 9/1943 | Predit, Jr. | 108/81 |
| 2,352,837 | 7/1944 | Hillenbrand | 108/81 X |
| 2,835,522 | 5/1958 | Serto . | |
| 2,872,260 | 2/1959 | Walter . | |

FOREIGN PATENT DOCUMENTS

| | | |
|---|---|---|
| 17730 | 12/1887 | United Kingdom . |
| 755640 | 1/1955 | United Kingdom . |
| 769119 | 2/1955 | United Kingdom . |

*Primary Examiner*—Alvin C. Chin-Shue
*Assistant Examiner*—David L. Talbott
*Attorney, Agent, or Firm*—George Pappas

[57] ABSTRACT

A leaf support for selectively supporting and placing drop leaves of tables and wall mounts in an in use position or a storage position. The leaf support includes a pair of channel-shaped arms pivotally connected at one end about an arms pivot axis. The other ends of the arms are adapted for pivotal attachment to a drop leaf or frame to which the drop leaf is connected. A helical spring is located within the channel-shaped arms and connected to the two arms at its ends thereof. A ring and cover member including a U-shaped member having a base portion and two legs attached thereto and a ring connected to the base portion is provided. The two arms near their pivotal connection are received within and between the two legs and the legs are pivotally connected to the arms so as to pivot about the arms pivot axis. The legs are triangularly shaped increasing in size towards the base portion and a substantially flat base portion is provided so as to, along with the triangularly-shaped arms, cover the pinch point or area between the two arms. The ring is connected to the base portion for grasping and pushing and pulling the leaf support arms between the in use and storage positions.

30 Claims, 2 Drawing Sheets

DROP LEAF SUPPORT WITH SAFETY RING AND COVER

BACKGROUND OF THE INVENTION

The present invention relates generally to drop leaf supports used to support and hold in position extension leaves of tables, wall mounts, etc. Leaf supports are used to selectively retain, for example, a table drop leaf in the same plane as the table and/or cause the leaf to be pivoted and "drop" in a position away from the plane of the table making the table smaller in size. More specifically, the present invention relates to a safety apparatus for use in conjunction with a drop leaf support whereby the leaf support may easily be grasped and pushed or pulled causing it to pivot along with the table leaf or wall mount. Furthermore, the present invention relates to an apparatus for covering the leaf support hinged opening or pinch point for helping prevent the accidental pinching of one's fingers during operation of the leaf support.

Drop leaves and wall mounts, etc., are generally pivotally connected to the end of a table or to a wall so as to be selectively pivoted between an in use position and a storage position. For example, a table drop leaf is generally pivoted between an in use horizontal position and a vertical storage position.

Leaf supports of various types are used for selectively placing and retaining the leaves of tables and wall mounts in their in use position. One such leaf support used with tables includes a cantilever slidingly mounted on the underside of the table and adapted to slide outwardly and underneath the drop leaf after the drop leaf has been pivoted in its in use horizontal position.

Another type of leaf support and to which the present invention pertains, includes a first arm pivotally connected to the leaf of, for example, a table and a second arm pivotally connected to the table at a location below the table top. Further, the two arms are pivotally connected to one another so that when the two arms are both longitudinally arranged with respect to one another and form a substantially straight line, the table drop leaf is retained in its in use horizontal position by the support. In essence, the support acts as a brace situated at an angle below the table drop leaf. Further, the drop leaf is placed in its storage position by "breaking" the support and causing the two arms to pivot with respect to one another downwardly and in a position almost parallel to one another.

The two arms can be elongate channel shaped so that the two arms can be pivotally connected together at the walls of the channels and above the bottom of the channel. A tension spring is situated within the channel, one end being connected to one arm and the other connected to the other arm. When the arms are situated longitudinally with respect to one another, the tension spring is located between the bottom of the channel and the pivot point between the two arms and, thus, retains the arms in that position. The "breaking" of the support requires a force substantially perpendicular to the longitudinal arms causing the spring to be placed in greater tension until after the spring passes the pivot axis between the two arms and its two connecting ends begin to get closer to one another as the arms are pivoted further and the leaf placed closer to its storage position.

When placing the drop leaf back in its in use horizontal position, the two arms are pivoted with respect to one another and toward the position where both arms are longitudinal with respect to one another. However, as the two arms are pivoted in this fashion, what is commonly known as a "alligator mouth" or a "pinch point" is formed between the ends of the channels and below the pivot axis of the two arms. Should one's fingers become caught in this "alligator mouth", they will, in all likelihood, become pinched and potentially cause the user of the drop leaf support great pain. The possibility of one's fingers becoming pinched is increased when a spring is used because, as the arms reach their longitudinal position after the spring passes the pivot axis between the arms and before the arms reach their final longitudinal position, the spring causes the support arms to snap or quickly move toward and into their respective longitudinal position.

In the past, various means have been devised for helping to prevent one's fingers from being pinched while operating a leaf support of this character. For example, as shown in U.S. Pat. Nos. 2,835,522 and 1,918,040 along with British patent No. 769,119, finger gripping portions have been rigidly attached to an arm of the leaf support for gripping while placing the leaf support in its in use or storage position. However, these finger gripping portions fail to effectively cover the pinch point while being operated and, thus, one's finger or thumb situated near the finger gripping portion may still become caught and pinched. Further, one's fingers could readily slip off the gripping portion and into the "alligator mouth" or "pinch point".

Accordingly, a need still exists for a leaf support employing a means through which one's fingers and thumb are substantially prevented from being pinched during the operation of the leaf support and, further, employing a means whereby the leaf support can be more rigidly gripped for preventing the accidental slipping of one's fingers or thumb into the pinch point.

SUMMARY OF THE INVENTION

The leaf support, according to the present invention, is designed to overcome the above-discussed disadvantages associated with prior leaf supports and to fill the above-discussed needs associated therewith.

The leaf support, according to the present invention, includes two arms, one of which is adapted to be pivotally connected to a leaf and the other of which is adapted to be pivotally connected to a support such as, for example, a leg or base of a table. The two arms are elongate and channel-shaped and the walls of the channels of the two arms are pivotally connected together about a arms pivot axis. A helical spring in tension is provided and connected, at one end, to the bottom of one of the arm channels and, the other end of the spring is connected to the bottom of the other arm channel. When the two arms are situated longitudinally with respect to one another, the helical spring is in tension and situated between the bottom of the arm channel portions and the arms pivot axis and, thus, helps retain the two arms in that elongate position. When the two arms are "broken" and caused to pivot with respect to one another, the helical spring at first experiences a greater amount of tension and, thus, causes a slight amount of resistance against the pivoting of the arms. However, after the spring passes the arms pivot axis, the tension of the spring causes the arms to more readily pivot with respect to one another toward a more parallel position with respect to one another.

When placing the leaf support in its in use position whereat the two arms are substantially longitudinally situated with respect to one another, the spring acts to at first resist the placement of the leaf support in that position. However, after the spring passes the arms pivot axis and is located between the arms pivot axis and the arm channel bottom portions, the spring more readily pulls the leaf support towards its in use position whereat both arms are situated substantially longitudinally with respect to one another.

A ring and cover member is provided and includes a U-shaped member having two legs connected to a base portion. The legs are pivotally connected to the arms so as to pivot about the arms pivot axis. The arms are flat and triangularly-shaped and increase in size towards the base. The base includes a substantially flat portion. The arms and base flat portion substantially cover the area between the arms and near the pivotal connection between the two arms (pinch point or area) and aid in preventing one's fingers or thumb from becoming caught between the two arms when the arms are being placed in their in use position.

An elongate rounded portion is connected to the base of the U-shaped member and forms a ring which is substantially parallel situated with respect to the arms. The ring has an opening or gripping hole of sufficient size for one's finger so that it may easily be grasped and pushed and pulled so that the arms of the leaf support may be readily pivoted about the arms pivot axis. As can be appreciated, the ring aids in preventing one's finger or thumb from slipping during the use of the leaf support and possibly getting caught within the pinch point between the two arms.

The other ends of the arms are adapted to be pivotally connected to a leaf or table support and include pivotally attached ears. The ears are adapted to pivot about attachment pivot axes situated substantially parallel to the arms pivot axis. The ears further include holes for receiving screws therethrough for mounting or attaching the ears on a leaf or support. A bracket can be provided rather than an ear so as to mount the end of the arm, for example, to the bottom of the table at a distance below therefrom.

In one form thereof, the present invention is directed to a leaf support having a pair of elongate arms pivotally connected together at one end about an arms pivot axis. The arms at their other ends are adapted for pivotal attachment about attachment pivot axes substantially parallel to the arms pivot axis. Ring means is provided and is pivotally connected to the arms about the arms pivot axis for grasping and pushing and pulling the arms to pivot about the arms pivot axis.

In one form thereof, the present invention is directed to a leaf support having a pair of elongate channel-shaped arms. Each of the arms has a bottom portion connected to two substantially upstanding walls and the walls of the arms are pivotally connected together at one end about an arms pivot axis located above the arm bottom portions. The arms at their other ends are adapted for pivotal attachment about attachment pivot axes substantially parallel to the arms pivot axis. A cover means is provided and is pivotally connected to at least one of the arms for covering an area substantially between the arms and near the pivotal connection between the two arms.

In one form thereof, the present invention is directed to a leaf support having a pair of elongate channel-shaped arms. Each of the arms has a bottom portion connected to two substantially upstanding walls and the walls of the arms are pivotally connected together at one end about an arms pivot axis located above the arm bottom portions. The arms at their other ends are adapted for pivotal attachment about attachment pivot axes substantially parallel to the arms pivot axis. A cover means is provided and is pivotally connected to the arms about the arms pivot axis for covering an area substantially between the arms and near the pivotal connection between the two arms.

BRIEF DESCRIPTION OF THE DRAWINGS

The above-mentioned and other features and objects of this invention and the manner of obtaining them will become apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention in one form thereof and such exemplifications are not to be construed as limiting the scope of the disclosure or the scope of the invention in any manner.

DESCRIPTION OF A SPECIFIC EMBODIMENT

Figure 2:
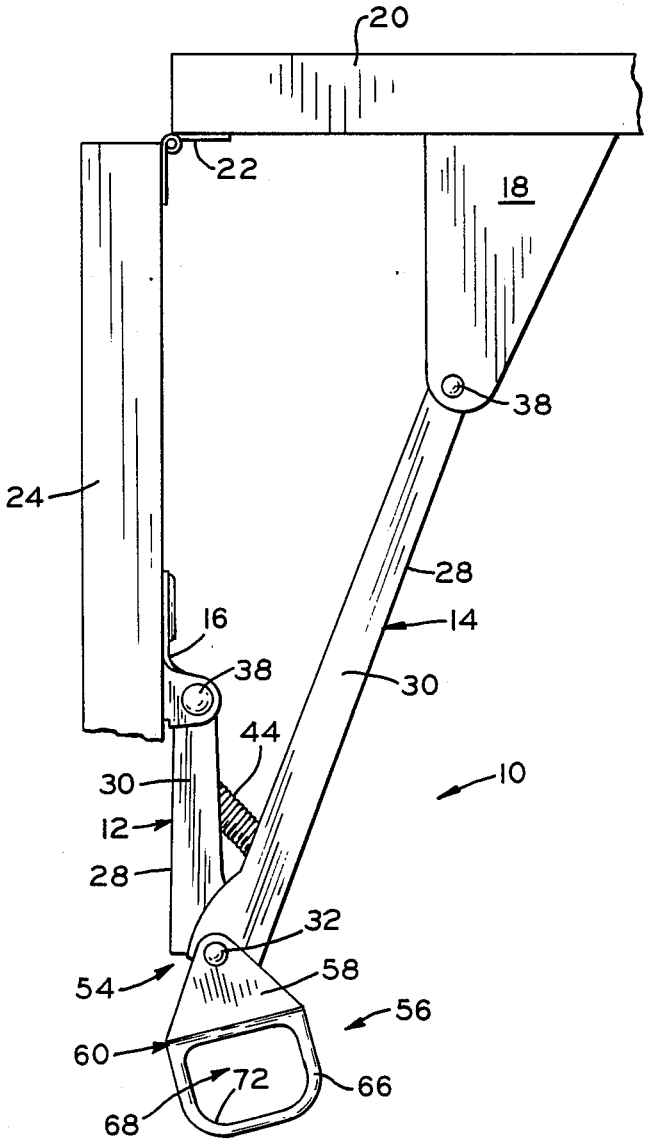
FIG. 2 is a side elevational view of the leaf support shown in FIG. 1 and in its storage position.

The leaf support apparatus, according to the present invention is shown in the drawings generally as 10. More specifically, leaf support 10 includes elongate arms 12 and 14 pivotally connected together at their one end about arms pivot axis A. As shown, elongate arm 12 is smaller in longitudinal length than elongate arm 14. Both arms 12 and 14, at their other ends thereof have pivotally attached thereto about attachment pivot axes B, ears 16. In FIG. 2, arm 14, rather than being connected to an ear, is pivotally connected to a triangular brace 18.

Figure 1:
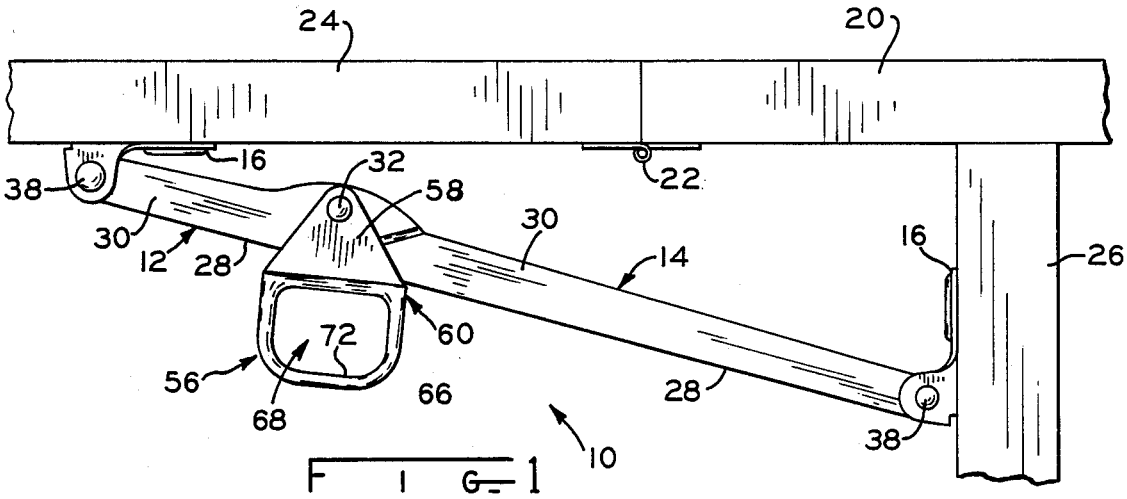
FIG. 1 is a side elevational view of the leaf support according to the present invention and shown in its in use position.
Figure 8:
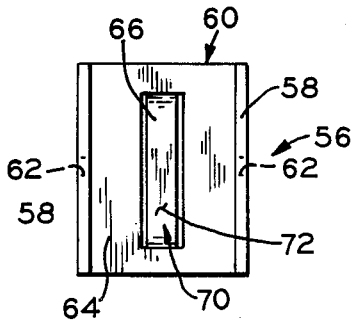
Figure 7:
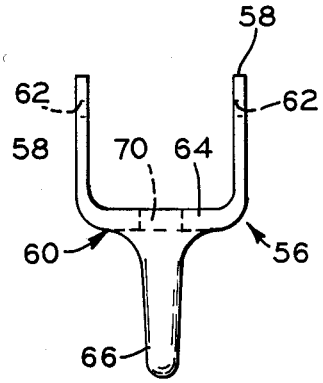
FIG. 7 is a side elevational view of the ring and cover member of leaf support shown in FIG. 1; and, FIG. 8 is a top plan view of the ring and cover member shown in FIG. 7.

Leaf support 10 is shown in FIGS. 1 and 2 in conjunction with a table top 20 to which there is pivotally connected through table hinge 22 a table drop leaf 24. Table drop leaf 24 and leaf support 10 are shown in their in use or operative position whereat leaf 24 is horizontally disposed with table top 20 and both arms 12 and 14 are situated longitudinally with respect to one another. In FIG. 2, drop leaf 24 is shown in its storage position whereat it is substantially vertically situated and arms 12 and 14 are almost parallel with respect to one another.

In its operative position, as shown in FIG. 1, leaf support 10 extends on an incline upwardly toward leaf 24 and supports the same in that fashion. In this regard, ear 16 connected to arm 12 is rigidly attached to leaf 24 and ear 16 connected to arm 14 is rigidly attached to a table support member such as a table leg 26 at a location below table top 20. Where a table leg 26 is not available for mounting ear 16 of arm 14 at a distance below table top 20, a triangular brace 18 is used as shown in FIG. 2. Triangular brace 18 is rigidly connected to the underside of table top 20 and extends the pivotal attachment about attachment pivot axis B to arm 14 to the proper distance vertically below table top 20.

Figure 3:
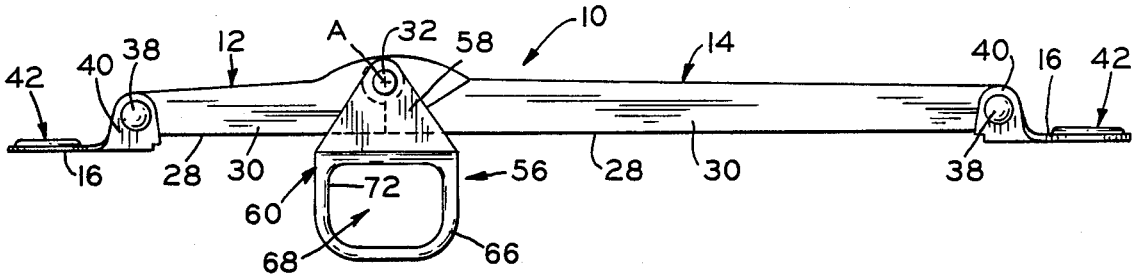
FIG. 3 is a side elevational view of the leaf support shown in FIG. 1.
Figure 4:
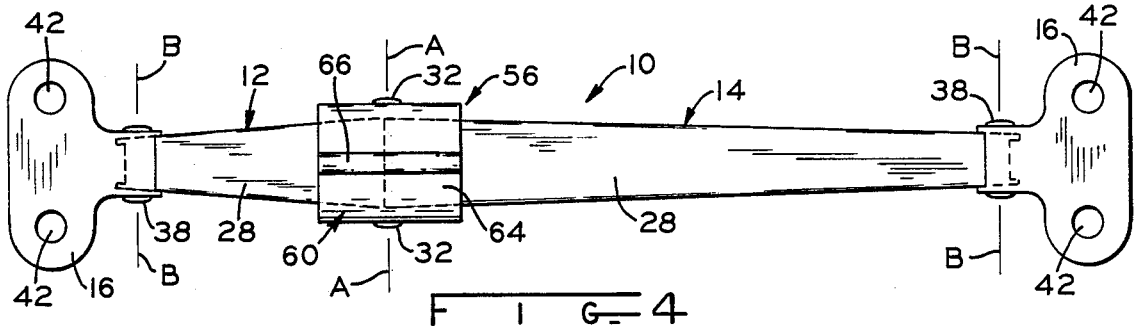
FIG. 4 is a bottom plan view of the leaf support shown in FIG. 3.
Figure 5:
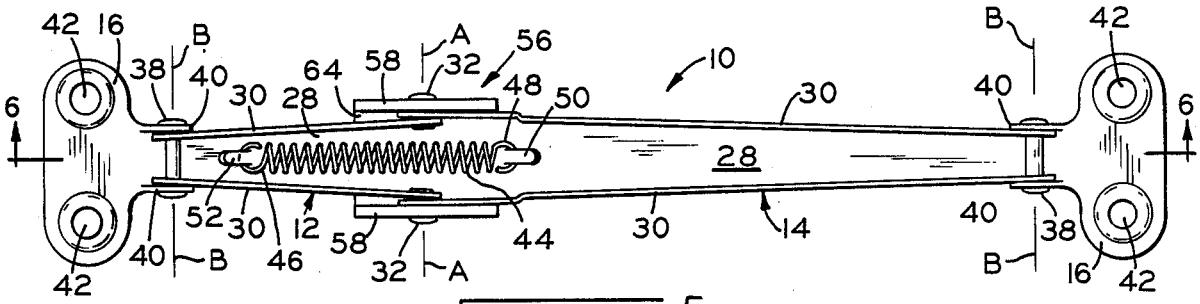
FIG. 5 is a top plan view of the leaf support shown in FIG. 3.
Figure 6:
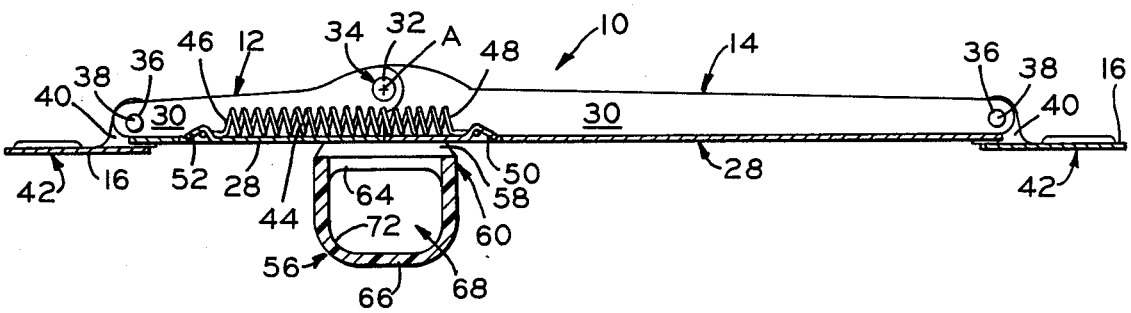
FIG. 6 is a cross sectional view of the leaf support taken along line 6—6 of FIG. 5.

Arms 12 and 14 are channel-shaped and include channel bottom portions 28 integrally connected to upstanding channel walls 30. Upstanding walls 30 of both arms 12 and 14 at both ends thereof have a hole for receiving therethrough a rivet-type connector as shown. As shown in FIGS. 3–6, when arms 12 and 14 are situated longitudinally with respect to one another, their respective channel bottom portions 28 abut one another. Further, walls 30 of arm 12 extend in between walls 30 of arm 14 so that the holes in walls 30 of both arms 12 and 14 align with one another for receiving arm pivot attachment rivets 32 therethrough. More specifically, as shown in FIG. 6, hole 34 in wall 30 of arm 12 and a hole therebehind in wall 30 of arm 14 receive arm pivot attachment rivet 32 so that arms 12 and 14 may pivot therearound. Accordingly, arms 12 and 14 pivot about arms pivot axis A as shown in FIG. 2, however, are prevented from pivoting beyond the longitudinal position as shown in FIG. 3 through the abutment of channel bottom portions 28 of arms 12 and 14.

Walls 30 of arms 12 and 14 at the ends opposite the pivot connection about arms pivot axis A have holes 36 for receiving therethrough ear attachment rivets 38. Ears 16 have connected thereto upstanding walls 40. Walls 40 have holes therethrough that are aligned with holes 36 of arms 12 and 14 and also receive therethrough attachment rivets 38. Thus, ears 16, through attachment rivets 38 are connected to the ends of arms 12 and 14 and pivot about attachment pivot axes B. It should be noted that ears 16 include attachment holes 32 for receiving therethrough an attachment means such as a wood screw for attachment to a leaf or table as shown in FIGS. 1 and 2.

A helical tension spring is provided for helping retain leaf support 10 in its longitudinal in use position as shown in FIG. 1. More specifically, helical spring 44 has a first end 46 and a second end 48. Further, a finger 50 is punched into the channel bottom portion 28 of arm 14 and extends within the channel of arm 14 and a finger 52 is punched into channel bottom portion 28 of arm 12 and extends within the channel of arm 12. Spring end 48 is connected to finger 50 of arm 14 and spring end 46 is connected to finger 52 of arm 12. As shown in FIG. 6, spring 44 is located below arms pivot axis A and above channel bottoms 28 and is in tension thereby pulling the channel bottom portions 28 together and in abutment to one another. In operation, when "breaking" arms 12 and 14, from their in line longitudinal position, tension spring 44 at first is pulled further apart as fingers 50 and 52 extend further apart as they pivot about arms pivot axis A. During this stage, spring 44 causes resistance to the pivoting of arms 12 and 14. After spring 44 passes pivot axis A or arms 12 and 14 are less than approximately 160 degrees from one another, and substantially until arms 12 and 14 reach their storage position as shown in FIG. 2, spring 44 acts to pull arms 12 and 14 together to an in storage position.

In the storage position, a pinch point or area or alligator mouth 54 is exposed between arms 12 and 14. Pinch area 54 becomes progressively smaller as leaf 24 is pivoted from its in storage to its in use position and one's fingers may become pinched if caught in pinch point 54 or therearound during operation of leaf support 10. To aid in preventing one's fingers from becoming caught within or around pinch point 54, a ring and cover member 56 is provided and is pivotally attached to arms 12 and 14 via rivets 32 so as to pivot about arms pivot axis A. As described herein, ring and cover member 56 includes a cover means for covering the pinch point 54 and the area therearound substantially between the arms 12 and 14 near the pivotal connection therebetween and, further, includes a ring means for grasping and pushing and pulling arms 12 and 14 for causing arms 12 and 14 to pivot about axis A and substantially preventing one's fingers from slipping off of the ring and cover member 56 and into the pinch point 54.

Ring and cover member 56 is U-shaped and has two legs 58 integrally connected to a base portion 60. Legs 58 are substantially flat and triangularly-shaped and increase in size from the pivotal connection about pivot axis A towards their connection to the base portion 60. Legs 58 have holes 62 wherethrough rivets 32 are received for pivotally attaching legs 58 to walls 30 of arms 12 and 14 as shown in FIG. 5. Base portion 60 includes a substantially flat rectangularly-shaped portion 64 which, in conjunction with legs 58 acts to cover pinch point 54. Further, by pivotally connecting ring and cover member 56 through the use of rivets 32 about arms pivot axis A, manufacturing costs are decreased while, simultaneously, an effective safety ring and cover is provided at the location where this is most needed.

A ring member 66 is connected to the base portion 60 of ring and cover member 56 and defines a finger gripping hole 68. Ring member 66 comprises of a band connected to base portion 60. Molding rectangular hole 70 located in base flat portion 64 of base portion 60 is used when injection molding the ring and cover member 56 for receiving a cam therethrough and to define the inner circumference 72 of ring member 66.

Ring and cover member 56 is preferably made of a nylon plastic and is injection molded. Arms 12 and 14 and ears 16 along with triangular brace 18 are preferably formed of sheet metal and are stamped to form their respective shapes.

As shown, arms 12 and 14 substantially near pivot axis A are received within the U-shaped member formed of legs 58 and base portion 60 and pinch point or area 54 is effectively covered thereby. In operation, when "breaking" leaf support 10 from its in use position as shown in FIG. 1, one need only place a finger through finger gripping hole 68 and pull ring member 66 downwardly causing arms 12 and 14 to pivot and leaf 24 to drop downwardly. As can be appreciated, ring 66 aids in preventing one's fingers from slipping during this operation and becoming caught by the moving arms 12 and 14 either in the pinch point or area 54 or thereabove between arms 12 and 14.

When placing leaf 24 in its operative in use position, one again places a finger within finger gripping hole 68 and pushes ring 66 and/or base portion 60 towards arms 12 and 14 causing arms 12 and 14 to pivot outwardly and toward their longitudinal in use position. Generally, one may also aid the operation of the leaf support by grasping leaf 24 and pulling the same toward its in use horizontal position. As can be appreciated, during this operation, ring and cover member 56 increasingly covers a greater portion of the pinch point or area as the leaf support reaches its in use longitudinal position. Further, ring 66 helps prevent one's fingers from slipping and possibly becoming caught in the pinch point area or thereabove and/or merely scraped against the leaf support or other parts therearound.

While the invention has been described as having a specific embodiment, it will be understood that it is capable of further modifications. This application is, therefore, intended to cover any variations, uses, or adaptations of the invention following the general principal thereof and including such departures from the present disclosure as come within known or customary practice in the art to which this invention pertains and fall within the limits of the appended claims.

What is claimed is:

1. A leaf support comprising:

a pair of elongate arms pivotally connected together at one end thereof about an arms pivot axis;

said arms at their other ends thereof adapted for pivotal attachment about attachment pivot axes substantially parallel to said arms pivot axis; and, ring means pivotally connected to said arms about said arms pivot axis for grasping and pushing and pulling said arms to pivot about said arms pivot axis.

2. The leaf support of claim 1 wherein said arms are channel-shaped having a bottom portion connected to two upstanding walls, said walls of said arms being pivotally connected above said bottom portion and said arms pivot axis being above said bottom portion.

3. The leaf support of claim 2 further comprising a spring having first and second ends, said spring first end connected to one of said arms and said spring second end connected to the other of said arms, wherein when said arms are substantially longitudinally situated to one another said spring is located between said arms pivot axis and said arm channel bottom portions and when said arms are less than 160 degrees apart from one another, said spring is located to one side of both said arms pivot axis and said arm channel bottom portions.

4. The leaf support of claim 2 wherein said ring means is a U-shaped member including two legs connected to a base portion, said arms received within said U-shaped member and said legs being pivotally connected to said arms about said arms pivot axis, and wherein a ring is connected to said U-shaped member.

5. The leaf support of claim 4 wherein said ring is situated substantially parallel to said arms.

6. The leaf support of claim 4 wherein said U-shaped base portion substantially covers an area between said arms and near said pivotal connection therebetween.

7. The leaf support of claim 6 wherein said ring is situated substantially parallel to said arms.

8. The leaf support of claim 6 wherein said base portion includes a substantially flat portion integrally connected to said legs and wherein said ring is integrally connected to said base portion.

9. The leaf support of claim 1 wherein an ear is pivotally attached to one of said other ends of said arms about said attachment pivot axis, said ear including a flat portion defining a hole therethrough.

10. The leaf support of claim 9 wherein a second ear is pivotally attached to the other one of said other ends of said arms about said attachment pivot axis, said second ear including a flat portion defining a hole therethrough.

11. The leaf support of claim 1 wherein said ring means is a U-shaped member including two legs connected to a base portion, said arms received within said U-shaped member and said legs being pivotally connected to said arms about said arms pivot axis, and wherein a ring is connected to said U-shaped member.

12. The leaf support of claim 11 wherein said U-shaped base portion substantially covers an area between said arms and near said pivotal connection therebetween.

13. The leaf support of claim 11 wherein said ring is situated substantially parallel to said arms.

14. The leaf support of claim 11 wherein said base portion includes a substantially flat portion integrally connected to said legs and wherein said ring is integrally connected to said base portion.

15. A leaf support comprising:

a pair of elongate channel-shaped arms each having a bottom portion connected to two substantially upstanding walls, said walls of said arms pivotally connected together at one end thereof about an arms pivot axis located above said arm bottom portions;

said arms at their other ends thereof adapted for pivotal attachment about attachment pivot axes substantially parallel to said arms pivot axis; and, cover means separate from said arms and pivotally mounted on at least one of said arms and for covering an area substantially between said arms and near said pivotal connection therebetween.

16. The leaf support of claim 15 wherein said cover means includes a U-shaped member having two legs connected to a base portion, said arms received within said U-shaped member and said legs being pivotally connected to at least one of said arms.

17. The leaf support of claim 16 wherein said U-shaped base portion includes a substantially flat portion connected to said legs and for covering said area substantially between said arms and near said pivotal connection therebetween.

18. The leaf support of claim 17 wherein said legs are substantially flat and triangularly shaped increasing in size from said pivotal connection on said arm and towards said substantially flat portion of said base portion.

19. The leaf support of claim 16 further comprising a ring member connected to said U-shaped member for grasping and pushing and pulling said arms to pivot about said arms pivot axis.

20. The leaf support of claim 15 wherein an ear is pivotally attached to one of said other ends of said arms about said attachment pivot axis, said ear including a flat portion defining a hole therethrough.

21. The leaf support of claim 16 further comprising a spring having first and second ends, said spring first end connected to one of said arms and said spring second end connected to the other of said arms, wherein when said arms are substantially longitudinally situated to one another said spring is located between said arms pivot axis and said arm channel bottom portions and when said arms are less than 160 degrees apart from one another, said spring is located to one side of both said arms pivot axis and said arm channel bottom portions.

22. The leaf support of claim 15 further comprising a spring having first and second ends, said spring first end connected to one of said arms and said spring second end connected to the other of said arms, wherein when said arms are substantially longitudinally situated to one another said spring is located between said arms pivot axis and said arm channel bottom portions and when said arms are less than 160 degrees apart from one another, said spring is located to one side of both said arms pivot axis and said arm channel bottom portions.

23. A leaf support comprising:

a pair of elongate channel-shaped arms each having a bottom portion connected to two substantially upstanding walls, said walls of said arms pivotally connected together at one end thereof about an arms pivot axis located above said arm bottom portions;

said arms at their other ends thereof adapted for pivotal attachment about attachment pivot axes substantially parallel to said arms pivot axis; and, cover means pivotally connected to said arms about said arms pivot axis and for covering an area substantially between said arms and near said pivotal connection therebetween.

24. The leaf support of claim 23 further comprising a spring having first and second ends, said spring first end connected to one of said arms and said spring second end connected to the other of said arms, wherein when said arms are substantially longitudinally situated to one another said spring is located between said arms pivot axis and said arm channel bottom portions and when said arms are less than 160 degrees apart from one another, said spring is located to one side of both said arms pivot axis and said arm channel bottom portions.

25. The leaf support of claim 23 wherein said cover means includes a U-shaped member having two legs connected to a base portion, said arms received within said U-shaped member and said legs being pivotally connected to said arms.

26. The leaf support of claim 25 wherein said U-shaped based portion includes a substantially flat portion connected to said legs and for covering said area substantially between said arms and near said pivotal connection therebetween.

27. The leaf support of claim 26 wherein said legs are substantially flat and triangularly shaped increasing in size from said pivotal connection to said substantially flat portion of said base portion.

28. The leaf support of claim 25 further comprising a ring member connected to said U-shaped member for grasping and pushing and pulling said arms to pivot about said arms pivot axis.

29. The leaf support of claim 23 wherein an ear is pivotally attached to one of said other ends of said arms about said attachment pivot axis, said ear including a flat portion defining a hole therethrough.

30. The leaf support of claim 29 further comprising a spring having first and second ends, said spring first end connected to one of said arms and said spring second end connected to the other of said arms, wherein when said arms are substantially longitudinally situated to one another said spring is located between said arms pivot axis and said arm channel bottom portions and when said arms are less than 160 degrees apart from one another, said spring is located to one side of both said arms pivot axis and said arm channel bottom portions.

* * * * *